United States Patent [19]

Lapier

[11] Patent Number: 4,756,111

[45] Date of Patent: Jul. 12, 1988

[54] RIFLE BARREL MOUNT FOR A TELESCOPE SIGHT

[76] Inventor: Richard C. Lapier, 111 Joes La., Hollister, Calif. 95023

[21] Appl. No.: 85,580

[22] Filed: Aug. 14, 1987

[51] Int. Cl.[4] ..... F41G 1/38

[52] U.S. Cl. ..... 42/101; 33/249; 42/75.01

[58] Field of Search ..... 42/101, 76.01, 77, 79; 33/245, 247, 249

[56] References Cited

U.S. PATENT DOCUMENTS

| | | | |
|---|---|---|---|
| 880,310 | 2/1908 | Klousnitzer | 33/247 |
| 1,022,249 | 4/1912 | Matheson | 33/245 |
| 1,974,016 | 9/1934 | Doe | 33/248 |
| 2,768,461 | 10/1956 | Whittemore et al. | 42/101 |
| 2,803,880 | 8/1957 | Weaver | 33/249 |
| 2,946,126 | 7/1960 | Simmons et al. | 33/245 |
| 3,339,450 | 9/1967 | Reed | 33/245 |
| 3,367,055 | 2/1968 | Powell | 42/79 |
| 3,491,975 | 1/1970 | Weaver | 42/101 |
| 4,299,044 | 11/1981 | Johannsen | 42/101 |

*Primary Examiner*—Deborah L. Kyle
*Assistant Examiner*—Michael J. Carone
*Attorney, Agent, or Firm*—Lothrop & West

[57] ABSTRACT

Rings of a pair of double-ring supports are screwed on a rifle barrel in respective front and rear positions and are held in longitudinal alignment by set screws in the supports engaged with recesses in the barrel. Other rings of the supports embrace and hold a telescopic sight with its axis parallel to the rifle barrel axis.

5 Claims, 1 Drawing Sheet

RIFLE BARREL MOUNT FOR A TELESCOPE SIGHT

BACKGROUND OF THE INVENTION

1. Field Of The Invention

The invention is in the field of devices for sighting or assisting in aiming firearms, particularly rifles.

2. Description Of The Related Art

Prior art telescopic sight mounts generally employ a set of blocks with an attached ring, such as the construction disclosed in U.S. Pat. No. 4,353,180 issued to Wilson, or they utilize a dovetail mount machined in the receiver, or barrel, for reception of the feet of clamps or rings which support the telescopic sight. Johannsen, U.S. Pat. No. 4,299,044 is exemplary of this latter approach.

Another area of related art pertains to muzzle chokes and the like, which disclose threaded barrels on shotguns to accommodate these devices. Of interest in this regard are the front sight 22' in Powell, U.S. Pat. No. 3,367,055 and the bead sight 20, in Moseley, U.S. Pat. No. 3,284,942. However, these sights are not part of a telescopic sighting system mounted upon assemblies threadably attached to a barrel as disclosed herein.

SUMMARY OF THE INVENTION

A mount for a telescope sight on a rifle barrel includes a rear sight support including a first ring rotatably threaded on barrel threads and including a second ring embracing a telescope sight. The mount also comprises a front sight support including another ring embracing the telescope sight. The telescope sight and rings can be moved around the barrel axis, except when restrained by set screws mounted in the rear and front sight supports. The set screws are adapted for manual rotation into normal engagement with the barrel.

DESCRIPTION OF THE PREFERRED EMBODIMENT

There are various desiderata for the use of telescopic sights in connection with rifles. One of the factors is to provide an accurate telescopic sight, mounted very close to the rifle barrel itself to avoid excessive parallax. It is further desirable to keep the weight of the sight and its mounting system as low as possible, so as not to upset the balance and handling characteristics of the rifle. In some instances, it is helpful to provide for moving the telescopic sight out of the way for use of the ordinary, integral sight on the rifle. Additional requirements are to avoid changing the construction of the rifle itself any more than is absolutely necessary and, as always, to provide an economical, simple construction.

Figure 1:
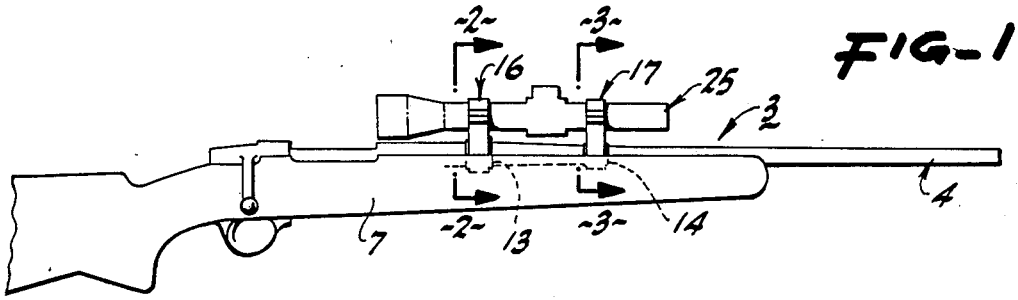
FIG. 1 is a side elevation of a rifle, a portion being broken away, showing a telescope sight thereon held by the mount of the invention.
Figure 2:
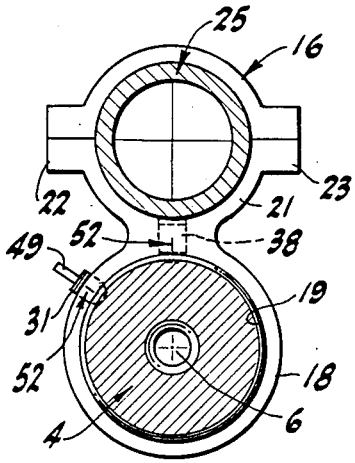
FIG. 2 is a cross-section, the plane of which is indicated by the line 2—2 of FIG. 1, the scale being substantially enlarged.
Figure 3:
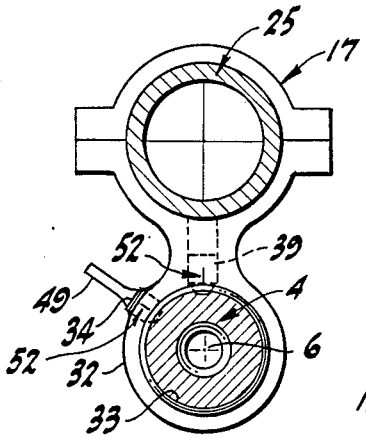
FIG. 3 is a cross-section similar to FIG. 2 and to the same enlarged scale, but taken at the plane indicated by the line 3—3 of FIG. 1.

In the present instance, there is provided a rifle 3 of any well-known and construction having a rifle barrel 4 extending along a center line 6 or axis (FIG. 2) and connected to a stock 7 and having the usual appurtenances.

Figure 5:
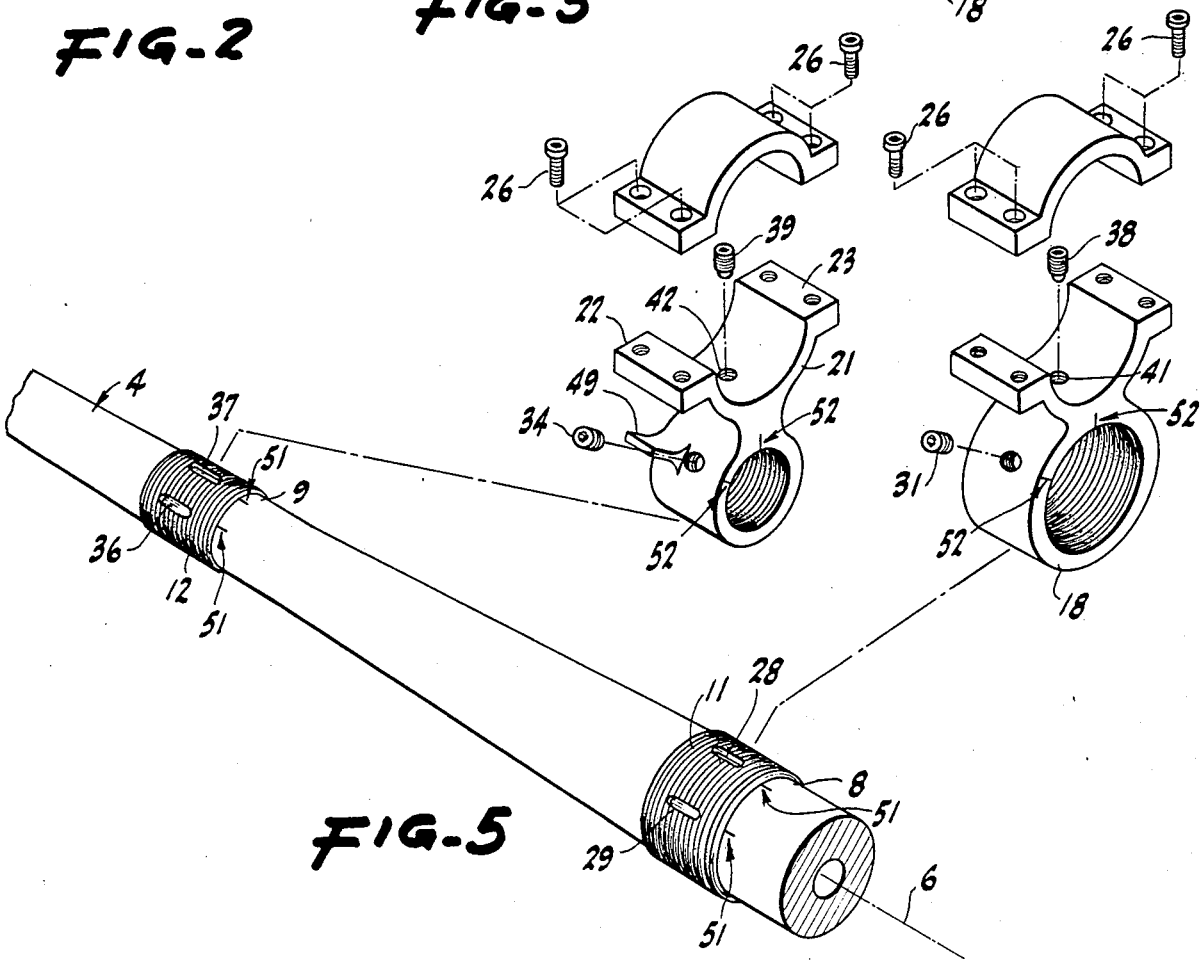
FIG. 5 is an exploded and diagrammatic view in isometric perspective showing a portion of the rifle barrel, parts being broken away, and the front and rear mounts in disassembled condition but in appropriate relationship of the parts for mounting on the rifle barrel.

Pursuant to this invention, especially as shown at the bottom of FIG. 5, the barrel 4 is provided with a rear enlargement 8 or boss constituting a minor increase in the rifle barrel diameter and of a limited axial extent. Forwardly on the barrel there is also provided another enlargement or boss 9. This also makes only a small increase in the barrel diameter and also is of a similar, limited axial length. The bosses 8 and 9 are both provided with outstanding threads 11 and 12 of a standard nature and of identical pitch and threading.

It is preferable, for purposes of maintaining absolute accuracy in placement and alignment of the sight, that the threaded bosses 8 and 9 be machined into the rifle barrel itself at the time of barrel manufacture. However, it is also contemplated that the bosses 8 and 9 could be formed by externally threaded sleeves (not shown), appropriately affixed to the rifle barrel during manufacture, or at some later time as a retrofit to an existing rifle. Either type of boss construction will work for the purposes of the present invention.

Adjacent the enlargements 8 and 9, the rifle stock 7 is relieved to provide recesses 13 and 14 to provide room for a rear sight support 16 and a front sight support 17. The rear support 16 includes a ring 18 of continuous, circular-cylindrical configuration around its interior provided with threads 19 that are engageable with the threads 11. Integral with and adjacent the ring 18 is another, articulated ring 21 preferably comprised of two portions, each having diametrically opposite tabs 22 and 23. These are drilled and threaded, as shown in FIG. 5, to receive fastening screws 26 for holding the parts together, when desired, about a standard telescopic sight 25.

Figure 4:
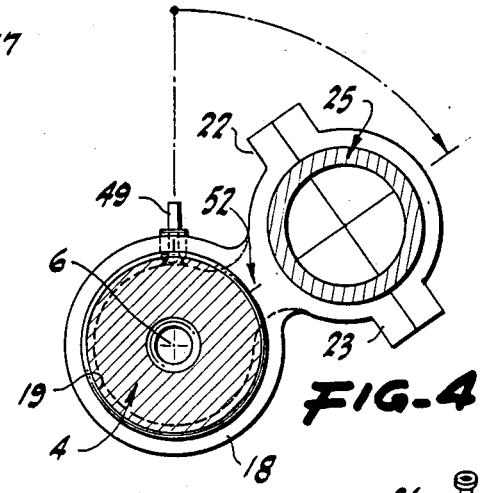
FIG. 4 is a view comparable to FIG. 2, but showing the mount and telescope structure rotated relative to the rifle barrel.

The interconnection of the lower ring 18 with the rifle barrel is sufficiently free under normal circumstances so that the ring can be swung around the axis 6 of the barrel into a different rotary position, as illustrated by FIG. 4. To hold the rear support in either one of two selected rotary positions, the barrel enlargement 8 is provided with elongated, circumferentially spaced dimples 28 and 29. A set screw 31 threadedly engages the lower ring 18 and can be wrench-tightened to seat in either one of the dimples 28 and 29 to hold the ring 18 in place.

In a similar fashion, the front support 17 includes a lower ring 32 having interior threads 33 engaging the threads 12 on the barrel and an adjacent articulated ring comparable to ring 21. In this fashion, the front support 17 can also be rotated about the axis 6. Similarly, the support 17 can be locked in either of two selected, rotational positions by a set screw 34 entering into either one of two dimples 36 and 37 extending through the threads. The dimples 28 and 29 as well as the dimples 36 and 37 are axially elongated so that the space between the rings 18 and 32 can be axially changed or either ring can be axially moved, without impairing the functionality of the dimples. The set screws 31 and 34 can be received by the dimples in any selected, axial position of the respective rings. If desired, and especially if ring rotation is infrequent, the set screws 31 and 34 can be supplemented by set screws 38 and 39 entering into central threaded apertures 41 and 42. The set screws in this instance are short enough so that when fully tightened they are entirely contained within the apertures 41 and 42.

The recesses 13 and 14 in the stock are sufficient so that when the set screws are appropriately withdrawn or loosened, the supports can simultaneously be rotated with the telescopic sight through approximately a fifty-five degree angle, as shown in FIG. 4, or into any side position out of the normal line of sight. In that instance, there is simultaneously brouhgt into the line of sight a fixed sight 49 upon the front sight 17 that can be used in the customary way. When the telescopic sight is again needed, it is simply rotated about the axis 6 and on the various threads 33 on 12 and 19 on 11 into its upright position. Aligning marks 51 on the barrel and marks 52 on the rear lower ring 18 and the front lower ring 32 are used for accurate re-positioning. The set screws such as 31 and 34 are again tightened for further fixed position use.

What is claimed is:

1. A rifle barrel mount for a telescopic sight comprising: a rifle barrel, said barrel having rear, external threads and front, external threads; a rear support structure including a pair of adjacent rear rings; threads in one of said rear rings engageable with and rotatable on said rear, external threads; a front support structure including a pair of adjacent front rings; threads in one of said front rings engageable with and rotatable on said front, external threads; and a telescope sight mountable on said rifle barrel by engagement with the other rings of said rear support structure and said front support structure, said front and rear support structures and said telescope sight being thereby adapted for simultaneous rotation from an above the barrel line of sight position into any desired side position around the barrel axis.

2. A device as in claim 1 including means for holding said support structures in predetermined positions of rotation relative to said barrel.

3. A device as in claim 1 including set screws in said rings movable into and out of engagement with said barrel.

4. A device as in claim 3 including at least one dimple disposed in each of said front and rear threads, for engagement by said set screws.

5. A rifle barrel mount for a telescope sight comprising a rifle barrel; means for providing rear, external threads on said rifle barrel; a rear support structure including a pair of rear rings; means on one of said rear rings providing threads engageable with and rotatable on said rear, external threads; a front support structure including a pair of front rings; means on one of said front rings providing threads engageable with and rotatable on said front, external threads; a telescope sight mountable on said rifle barrel by engagement with the other rings of said rear support structure and said front support structure; and means defining dimples elongated in the direction of said barrel and disposed in said thread-providing means.

* * * * *